United States Patent [19]

Cuomo et al.

[11] Patent Number: 4,471,224

[45] Date of Patent: Sep. 11, 1984

[54] APPARATUS AND METHOD FOR GENERATING HIGH CURRENT NEGATIVE IONS

[75] Inventors: Jerome J. Cuomo, Lincolndale, N.Y.; Harold R. Kaufman, Fort Collins, Colo.

[73] Assignee: International Business Machines Corporation, Armonk, N.Y.

[21] Appl. No.: 355,795

[22] Filed: Mar. 8, 1982

[51] Int. Cl.[3] ..... H01J 27/20

[52] U.S. Cl. ..... 250/423 R

[58] Field of Search ..... 250/423 R, 424; 313/359.1, 360.1, 362.1, 361.1, 363.1; 60/202; 156/345; 204/192 N, 192 E

[56] References Cited

U.S. PATENT DOCUMENTS

| | | | |
|---|---|---|---|
| 2,975,279 | 3/1961 | Craig | 250/423 R |
| 3,082,326 | 3/1963 | Arnold | 376/116 |
| 3,275,867 | 9/1966 | Tsuchimoto | 313/361.1 |
| 3,279,176 | 10/1966 | Boden | 60/202 |
| 3,287,582 | 11/1966 | Baldwin et al. | 313/361.1 |
| 3,375,401 | 3/1968 | Consoli et al. | 315/111.81 |
| 3,376,469 | 4/1968 | Consoli et al. | 315/111.81 |
| 3,482,133 | 12/1969 | Dugdale et al. | 219/121 P X |
| 3,846,668 | 11/1974 | Ehlers et al. | 376/128 |
| 4,104,875 | 8/1978 | Birner et al. | 60/202 |
| 4,132,614 | 1/1979 | Cuomo et al. | 204/192 EC |
| 4,158,589 | 6/1979 | Keller et al. | 156/345 |
| 4,250,009 | 2/1981 | Cuomo et al. | 204/192 N |

OTHER PUBLICATIONS

Ayukhanov, A. Kh., and Chernenko, V. N., "Negative--Ion Source", *Instrum. & Exp. Tech.*, (USA), vol. 15, No. 2, Pt. 2, (Mar.-Apr. 1972), pp. 480-481.

*Primary Examiner*—Janice A. Howell
*Assistant Examiner*—Constantine Hannaher
*Attorney, Agent, or Firm*—Pollock, Vande Sande & Priddy

[57] ABSTRACT

Method and apparatus for generating high current, negative ion beams. A plasma source of ions of one charge polarity includes an accelerator for accelerating the ions toward a target having a plurality of apertures. An electric field directs the ions exiting the apertures against a target surface which is arranged to emit ions of an opposite polarity. The electric field directs the opposite polarity ions away from the target forming a stream of oppositely charged ions.

7 Claims, 3 Drawing Figures

APPARATUS AND METHOD FOR GENERATING HIGH CURRENT NEGATIVE IONS

DESCRIPTION

1. Technical Field

The present invention relates to the generation of high current negative ion streams.

2. Background Art

Negative ion streams are known in the art for use in sputtering techniques whereby refractory materials are machined through bombardment. The consequent erosion of the bombarded material is utilized with suitable masking techniques to precisely machine the target material. Also, sputtering deposition may be accomplished whereby material which is removed by ion bombardment becomes deposited on a substrate, once again through suitable masking procedures to provide a pattern of controlled deposition.

Generating dense, negative ion streams having a high current intensity has been difficult in the prior art. Some of the techniques used include a contact or surface ionization method, electron attachment in an electrical gas discharge, and negative ion emission from a surface due to positive ion bombardment.

With the first of these techniques, the limitation on the magnitude of a negative ion current results from an excessively large number of electrons produced which exceed the number of negative ions produced. Removal of the electrons from the ion streams is difficult and impractical in high current negative ion streams. The collisions between the negative ions and electrons results in a loss of negative ions. Systems of this type are described by N. Kashihira, E. Vietzke, Zellerman, "Source for Negative Halogen Ions", Rev. Sci Instrumentation Vol. 48, pp. 171–172, Feb. 1977. The gas discharge technique similarly generates in addition to the desired negative ions other charged particles. Electron detachment occurs due to collisions between electrons and negative ions producing neutral particles rather than the desired negative ions. This technique is described in A. S. Kucheron, et al "Obtaining Intense Beams of Negative Hydrogen Ions", translated from Prebory Tekhnika Ekxperimenta, No. 4 July-August 1975, pages 21–23.

In the third technique for generating negative ions, space charge effects are produced when a positive ion stream is directed against a surface which produces negative ions. If no neutralizing electrons are supplied to the positive ion beam, space charge effects will limit the current carrying capacity of the ion beam. When the positive ion beam is neutralized with a source of electrons from the plasma which generates the positive ions, the ion generating system becomes heavily loaded. This technique is described in V. E. Krohn.; "Emissions of Negative Ions from Metal Surfaces Bombarded by Positive Ions", J. App. Phys., Vol. 33, pp 3523, 3525, December 1961.

Thus the prior art techniques all suffer from the generation of spurious particles such as free electrons which limit the magnitude of a high current, negative ion stream; or subject to limitations imposed on negative ion generation due to space charge effects.

SUMMARY OF INVENTION

It is a primary object of the invention to provide a high current ion beam.

It is a more specific object of the present invention to reduce space charge generation when positive ions are directed against a negative ion producing surface.

It is yet another object of this invention to generate a negative ion beam without generating electrons or other particles which will cause electron detachment from the negative ions.

These and other objects are provided by the apparatus and methods of the present invention in which a high current negative ion beam is generated. A source of positive ions is provided for directing a positive ion stream along a predetermined trajectory to a negative ion producing target, said target selected from a material which produces negative ions and uncharged sputtering particles. An electric field is established to force positive ions into the target and emitted negative ions away from the target.

In one embodiment of an apparatus in accordance with the invention, a positive ion source using a low pressure gas for ionization produces accelerated positive ions through an exit grid. Located a distance away from the exit grid is a grid of target material presenting to the positive ions a plurality of apertures for passing the ions to an opposite side of the target material. The exit side of the target material includes a material which upon bombardment by a positive ion produces negative ions and neutral sputtered particles. An electric field is established on the exit side of the target material for forcing exiting positive ions into collision with the exit side of the target material. The electric field accelerates the surface produced negative ions away from the target material.

BEST MODE FOR CARRYING OUT THE INVENTION

Figure 1:
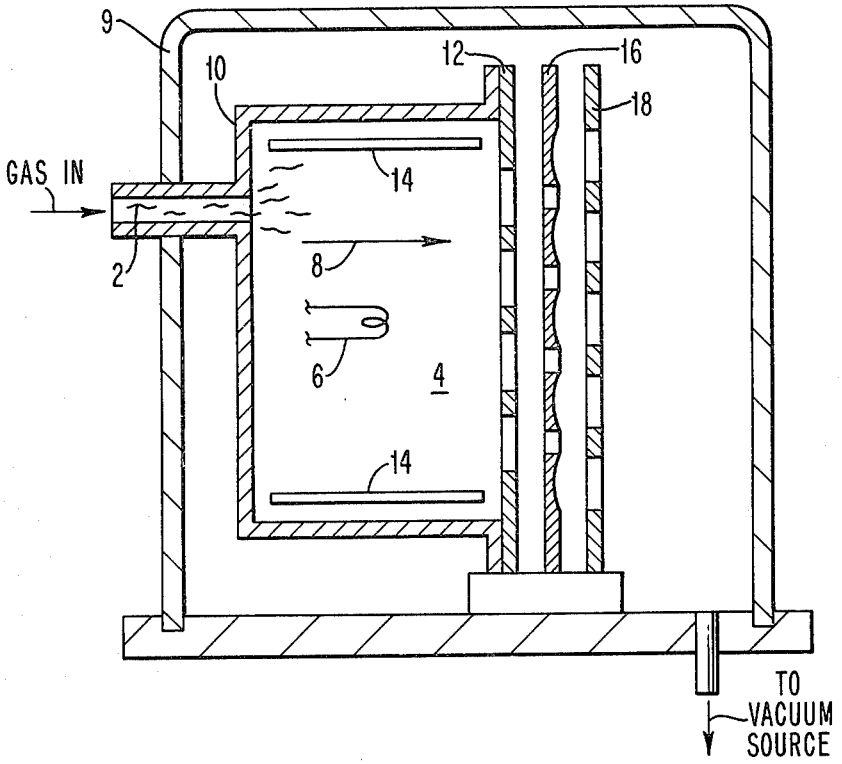
FIG. 1 illustrates one embodiment of apparatus for generating a negative ion stream in accordance with the present invention.
Figure 2:
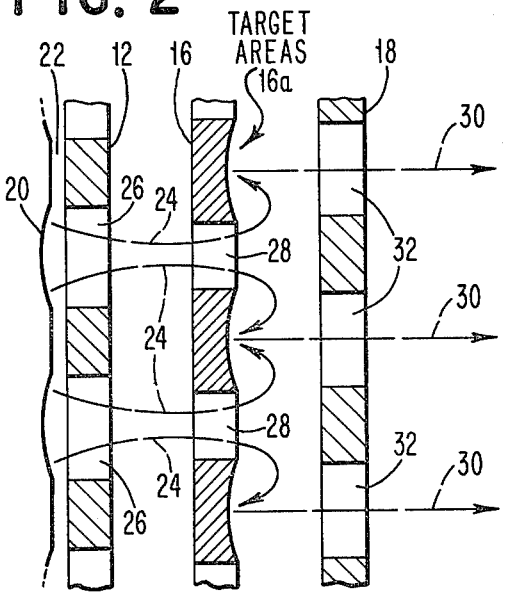
FIG. 2 is a partial section view of the grid and target apertures of FIG. 1.

Referring now to FIGS. 1 and 2, there is shown an apparatus for generating a high current negative ion stream in accordance with a preferred embodiment of the present invention. A plasma generating chamber 10, located within a sealed housing 9, receives a gas at comparatively low pressure via an inlet 2. The gas may be argon, or another gas capable of generating positive ions. An anode 14 and cathode 6 are connected to a source of electrical potential in a manner known to those skilled in the art to generate electrons from the cathode 6. The electrons migrate to the anode 14 causing collisions with the gas molecules along the way. The low pressure within the chamber 10 is subjected to a magnetic field 8 produced by a coil or permanent magnet adjacent the chamber 10, which, as is known to those skilled in the art, improves the ionization efficiency of the gas. A screen grid 12 disposed at one end of chamber 10 provides an exit port for the ions produced by the collisions of electrons traveling to the anode from the cathode and the gas molecules. A sheath 22 forms within chamber 10 as a boundary around the plasma 20 providing an electron field barrier.

The voltage potential of the plasma 20 within the chamber 10 is established to be approximately 0 volts.

The screen grid 12 is maintained at a negative potential such as −50 volts sufficient to reflect electrons generated in the plasma away from the screen grid.

Located within housing 9 at a distance from screen grid 12 is a target 16 which also serves as an accelerator for positive ions which exit the apertures 26 in screen grid 12. The target 16 has a plurality of apertures 28 which are generally aligned with the apertures 26 of screen grid 12. The target 16 is maintained at a potential, typically −1000 volts, to produce efficient sputtering when struck by positive ions. The target material includes on the exit side 16*a*, material which emits negative ions in response to bombardment by positive ions. The material of the target, at least on the exit side 16*a*, is a samarium gold alloy (SmAu), the samarium and gold having approximately equal atomic percentages, selected to produce mostly negative ions. The alloy produces, in addition to negative ions, neutral particles which do not result in a current limiting space charge forming at the target 16 surface.

A second screen grid 18 having a voltage potential which is positive with respect to target 16 reverses the direction of the positive ion flow exiting the target apertures 28. The screen grid 18 has a plurality of apertures 32 which pass emitted negative ions of gold in the case of preferred embodiment. The apertures 32 are located opposite the ion emitting surface 16*a*. The ion emitting surface 16*a* is contoured into a plurality of concave surface regions between the apertures 26, which function to focus and direct ions towards screen 18 and to provide the optimum trajectory for emitted negative ions with respect to the apertures 32 facing the target surface 16*a*. The screen grids 12, 18, target 16 and chamber 10 are maintained in a vacuum through pump connection 17 for evacuating a sealed housing 9.

The potential on screen grid 18 is maintained at about 0 volts. The grid 18 repels positive ions against the target surface 16*a*. The negative ions are accelerated away from the target 16 towards the screen grid 18 by the voltage potential between screen grid 18 and target 16. Apertures 32 pass the negative ions 30 forming a collimated beam.

In practice the target apertures 28 have a diameter approximately 65% of the screen grid apertures 26. This reduces the number of positive ions which pass back through apertures 28 and subsequently collide on the inlet side of target 16. The spacing between screen grid 12 and target 16 is substantially equal to the diameter of apertures 26. The total amount of negative ion current is increased by increasing the number of apertures in the screen grids 12, 18 and target 16.

Figure 3:
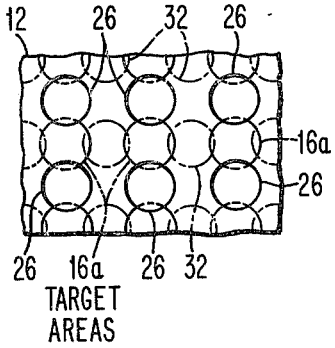
FIG. 3 is a side view of the grid and target apertures of FIG. 2.

Referring to FIG. 3, a direct view of the relationship between the target 16 and screen grids 12, 18 is shown. The target areas 16*a* are located at the center of each tripod formed by the apertures of screen grid 12. The offset of apertures 32 with respect to apertures 28 and 26 increases the percentage of negative ions which pass through grid 18.

The apparatus of FIG. 1 may be used to produce neutral particles by combining a low energy beam of positive ions with the negative ion beam produced by screen grid 18. Although screen grid 18 has been described as being operated at zero voltage potential, if positive ions are added to the negative ion beam a slightly positive voltage potential should be maintained on screen grid 18 to prevent low velocity ions from entering apertures 32. Also, the beam can be neutralized by electron detachment produced by an extended region of high neutral pressure on the exit side of grid screen 18.

Thus, there has been described apparatus which generates a high current negative ion stream. The plasma which generates positive ions for bombarding the target material remains isolated from subsequent negative ions produced by the invention. The generation of surface charge is minimized and losses of negative ions occurring from electron detachment when negative ions collide with other particles is reduced. The foregoing description is exemplary only of the present invention which is more particularly defined by the claims which follow.

Industrial Application

The invention is useful for generating large current negative ion beams avoiding surface charge limitation and electron detachment experienced with other types and methods of generating large current ion beams.

Having thus described my invention, what I claim as new, and desire to secure by Letters Patent is:

1. An apparatus for generating a charged ion stream comprising:

a plasma generator having a chamber for receiving an ionizing gas, an anode and cathode, each connected to provide an ionizing current whereby a plasma is generated, a first screen located at an exit aperture of said generator for accelerating ions formed in said chamber along a trajectory path, a target material located along said trajectory path, said target material having apertures for passing said ions, said material comprising a material having the properties of emitting an ion with a charge polarity opposite an incident ion polarity, a second screen adjacent said target material having a plurality of apertures located in facing relation to an ion emitting surface of said target material, and means for applying a voltage potential between said second screen and said target material having a polarity for directing ions passing through said target apertures against said target material as they exit said target apertures whereby an oppositely charged ion is emitted from said target material and is accelerated by said voltage potential through the apertures in said second screen.

2. An apparatus for forming a stream of ions having a negative polarity comprising:

an ion generator for producing a stream of accelerated positively charged ions from a plasma, said generator including a plurality of exit apertures for emitting said ions;

a target material having apertures for passing ions incident on one side of said target material, and a target surface located on an opposite side of said target material; said target surface comprising an ion emitting material responsive to an incident ion; and means for establishing an electric field on said opposite side of said target material for forcing ions passing through said target material apertures against said target surface whereby an ion is emitted from said target material and subsequently accelerated by said field away from said target material.

3. The apparatus of claim 1 wherein said target material emitting said oppositely charged particles is shaped to direct said emitted ions through said second screen.

4. The apparatus of claim 1 wherein said target material apertures are smaller in diameter than said first screen exit apertures to minimize the number of ions which travel through said target apertures towards said first screen.

5. The apparatus of claim 1 wherein the differences in the voltage potential between said first screen and target material is less than the potential difference between said second screen and said target material.

6. The apparatus of claim 1 or 2 wherein said target material comprises SmAu.

7. An apparatus for generating negative ions comprising:

a plasma generator comprising a chamber receiving a gas for ionization, an electron emitter and anode connected to ionize said gas whereby a plasma bordered by a plasma sheath is produced, said chamber having an exit port bounded by an exit grid having a voltage potential for accelerating positive ions in said chamber through said grid, said plasma generator further including a magnetic field for constraining energetic electrons generated in the plasma;

a target having a plurality of apertures for passing ions emitted by said grid, said target having a surface on the exit side of said target apertures for emitting negative ions along a predetermined trajectory in response to bombardment by positive ions exiting said target apertures;

a second grid for receiving ions emitted by said target surface;

and means for applying between said target surface and second grid a voltage potential for establishing a field for reversing the direction of travel of said positive ions exiting said target apertures whereby collisions with said emitting surface occur to produce negative ions that are swept by said field through said second grid thereby to form a stream of negative ions.

* * * * *